US006522850B2

(12) United States Patent
Hiroki

(10) Patent No.: US 6,522,850 B2
(45) Date of Patent: Feb. 18, 2003

(54) IMAGE FORMING APPARATUS HAVING SUPPORTING MEMBER FOR SUPPORTING PHOTOSENSITIVE BELT

(75) Inventor: Masashi Hiroki, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/898,481

(22) Filed: Jul. 5, 2001

(65) Prior Publication Data

US 2003/0007808 A1 Jan. 9, 2003

(51) Int. Cl.[7] ..... G03G 15/00
(52) U.S. Cl. ..... 399/164
(58) Field of Search ..... 399/228, 178, 399/164, 162, 116, 299; 347/115

(56) References Cited

U.S. PATENT DOCUMENTS 4,279,496 A * 7/1981 Silverberg ..... 271/275
4,891,674 A * 1/1990 Seyfried ..... 399/228
4,987,428 A * 1/1991 Bannai et al. ..... 347/119
5,168,318 A * 12/1992 Haneda et al. ..... 399/164
5,953,565 A * 9/1999 Fiore et al. ..... 399/164
6,032,014 A * 2/2000 Janssens et al. ..... 399/162

FOREIGN PATENT DOCUMENTS

JP 61151561 A * 7/1986 ..... G03G/15/01
JP 01081983 A * 3/1989 ..... G03G/21/00
JP 05040390 A * 2/1993 ..... G03G/15/01
JP 09-080860 3/1997
JP 10-058754 3/1998
JP 11-167277 6/1999

* cited by examiner

*Primary Examiner*—Robert Beatty
(74) *Attorney, Agent, or Firm*—Foley & Lardner

(57) ABSTRACT

In an image forming apparatus that has a photosensitive belt and developing rollers for developing images by bringing the photosensitive belt in contact with the developing rollers when developing images, supporting members are provided for supporting the photosensitive belt in the state it is oscillated according to the contacting force of the photosensitive belt with the developing rollers. Thus, a large pressure applied to the nip portion between the photosensitive belt and the developing rollers is prevented and further, the tensile force applied to the photosensitive belt is prevented from largely fluctuating when the developing rollers contact the photosensitive belt by intruding into it.

13 Claims, 15 Drawing Sheets

(TABLE 1)

| AMOUNT OF INTRUSION (mm) | DENSITY OF TONER IMAGE | INSUFFICIENT EXPANSION OF IMAGE | COLOR DEVIATION | HOMOGENEITY OF TONER IMAGE DENSITY IN MAIN SCANNING DIRECTION |
|---|---|---|---|---|
| 0 | 0 | — | — | — |
| 0.2 | 0.8 | ○ | ○ | △ |
| 0.5 | 1.4 | ○ | ○ | ○ |
| 1.0 | 1.4 | ○ | ○ | ○ |
| 2.0 | 1.4 | △ | × | ○ |
| 3.0 | 1.4 | △ | × | ○ |

FIG.7

IMAGE FORMING APPARATUS HAVING SUPPORTING MEMBER FOR SUPPORTING PHOTOSENSITIVE BELT

BACKGROUND OF THE INVENTION

1. Field of the Invention

The present invention relates to an image forming apparatus such as electro-photographing apparatus, printer, etc. and in particular to an image forming apparatus equipped with a photo-conductor and developing rollers which are brought in contact with each other only when developing images for forming developing images on the photosensitive belt.

2. Description of the Related Art

In image forming apparatus such as color copying machines, color printers, etc. to obtain color images according to electro-photographing system, an apparatus has been developed for obtaining a full color image using 4 color toners of yellow (Y), magenta (M), cyan (C), black (K). In this apparatus, four developing devices filled with respective color toners are brought in contact with or separating from a photosensitive belt or an intermediate transferring body according to colors of latent images to be formed on the photosensitive belt and after developing and superposing toner images in respective colors on the photosensitive belt or the intermediate transferring body, the images are collectively transferred on a recording paper.

In such the image forming apparatus, when bringing the photosensitive belt and plural developing devices are brought in contact with or separated from the photosensitive belt or separated therefrom, while the photosensitive belt is kept stationary, one of plural developing devices is moved or while the developing devices is kept stationary, the photosensitive belt is moved selectively to a position opposing to a prescribed developing device of the photosensitive belt, and the photosensitive belt and the developing rollers are thus contacted or separated.

However, when toner images in desired colors are formed on the photosensitive belt in order by bringing the photosensitive belt in contact with developing rollers or separating them, even when either the photosensitive belt or the developing devices are moved, the tensile force of the photosensitive belt differs when the photosensitive belt is in contact with the developing rollers or when they are separated, and the running speed of the photosensitive belt may fluctuate.

Therefore, as an image forming apparatus to move the developing devices to bring in contact with the photosensitive belt or separating from it, the technology to prevent fluctuation in the running speed of the photosensitive belt by keeping its tensile force constant by providing a roller to contact to the photosensitive belt or separate therefrom in addition to supporting rollers for stretching the photosensitive belt has been disclosed in Japanese Laid Open Patent Publication No. Hei 11-167277. Further, as an apparatus for moving the photosensitive belt to contact or separate to/from the developing devices, the technology to prevent fluctuation in the running speed of the photosensitive belt by moving plural back-up rollers corresponding to respective developing devices while keeping the running route of the photosensitive belt constant has been disclosed in Japanese Laid Open Patent Publication No. Hei 9-80860.

However, the existing technologies mentioned above maintains the tensile force of the entire photosensitive belt constant or maintains the running route of the entire photosensitive belt constant but do not adjusts the pressure produced between the photosensitive belt and the developing rollers nor adjust fluctuation of the tensile force applied to the photosensitive belt in the contacting area of the photosensitive belt with the developing rollers, and in the contacting area of the photosensitive belt and the developing rollers, improper images may be produced because the relative speed between the photosensitive belt and the developing rollers still fluctuates or the running speed of the photosensitive belt changes.

In particular, in developing devices that make the contact development using one-component developers, a sufficient amount of toner is supplied to the nip portion formed between the photosensitive belt and the developing rollers generally by increasing the running speed of the developing rollers higher than the running speed of the photosensitive belt and toner image fog is reduced. Thus, as the photosensitive belt and the developing rollers run by keeping a prescribed relative speed, if the pressure applied to the nip portion changes and a large pressure is applied between the photosensitive belt and the developing rollers during the running, the relative speed of the photosensitive belt and the developing rollers changes and developing characteristic changes, and improper images many be produced for improper development.

Further, in recent years, in a full color image forming apparatus, it is demanded to make developing devices and developing rollers small in size for making the entire apparatus small in size and light in weight. Therefore, when the developing rollers is made in a small diameter, in order to get a good image density in a sufficient developing time by performing the developing operation stably, it becomes necessary to secure a contacting area of the photosensitive belt and the developing rollers sufficiently by bringing them in contact with each other so as the developing rollers are intruded into the photosensitive belt. When the developing rollers are intruded into the photosensitive belt so as to intrude into there, even if the developing rollers and the photosensitive belt are not sufficiently paralleled, the developing rollers and the photosensitive belt are almost uniformly contacted each other for the overall length of the main scanning direction (the right angle direction to the running direction) and a uniform image density is obtained.

However, if the developing roller is excessively intruded into the photosensitive belt, the tensile force applied to the photosensitive belt changes largely when the photosensitive belt is in contact with the developing roller and when separated, and the running speed of the photosensitive belt may change largely by the change in torque applied to the driving device of the photosensitive belt and as a result, such improper images as elongation or contraction of images or color deviation of toner images in plural colors may be caused.

Accordingly, in order to prevent the deterioration of image quality described above, in an image forming apparatus to get a toner image by bringing the photosensitive belt and the developing rollers in contact with each other or separating them, it has been desired to get an image of good quality by obtaining a stabilized and sufficient developing density without impairing the small sized apparatus, adjusting the pressure applied to the contacting area of the photosensitive belt and the developing rollers, and adjusting the change in the tensile force applied to the photosensitive belt when the photosensitive belt and the developing rollers are in contact with each other and when they are separated.

SUMMARY OF THE INVENTION

It is an object of the present to provide a small size image forming apparatus without deteriorating quality of images.

It is another object of the present invention to provide an image forming apparatus which forms a good toner image by preventing a large pressure applied to a contact area of a photosensitive belt and developing rollers when developing an image by bringing the photosensitive belt in contact with or separating from the developing rollers and a relative speed of the photosensitive belt and the developing rollers from changing, and stabilizing developing characteristic.

It is a further object of the present invention to provide an image forming apparatus for forming a good toner image by preventing fluctuation of the tensile force applied to the photosensitive belt when the photosensitive belt is brought contact with the developing rollers irrespective of the developing rollers made small.

According to the embodiments of the present invention, an image forming apparatus comprising: an endlessly running image carrier; a latent image forming portion for forming a latent image on the image carrier; developing devices having developing members that are capable of contacting/separating to/from the image carrier after passing the latent image forming portion and forming developing image by supplying developers to the latent image; and supporting members contacting the surface of the image carrier opposite to the surface contacting the developing devices when the developing members contact the image carrier and supporting the image carrier movably according to the contacting force of the developing member with the image carrier is provided.

Further, according to the present invention, there is provided an image forming apparatus comprising: a belt-shaped photo-conductor; a latent image forming portion for forming a latent image on the photo-conductor; developing devices having developing rollers that are capable of contacting/separating to/from the photo-conductor after passing the latent image forming portion and for forming developing images by supplying developers to the latent image; developing device moving members for moving the developing devices and bringing the developing rollers in contact with or separating from the photo-conductor; and supporting members contacting the surface of the photo-conductor opposite to the surface contacting the developing rollers of the photo-conductor when the developing rollers contact the photo-conductor and support the photo-conductor movably according to the contacting force of the developing rollers with the photo-conductor is provided.

Further, according to the present invention, there is provided an image forming apparatus comprising: a belt-shaped photo-conductor; a latent image forming portion for forming a latent image on the photo-conductor; developing devices that are capable of contacting/separating to/from the photo-conductor after passing the latent image forming portion and have developing rollers for forming developing images by supplying developers to the latent image; a photo-conductor moving member for moving the photo-conductor to contact or separate the developing rollers; and supporting members that contact the surface of the photo-conductor opposite to the surface contacting the developing rollers when contacting the developing rollers to the photo-conductor and support the photo-conductor movably according to the contacting force of the developing rollers with the photo-conductor.

BRIEF DESCRIPTION OF THE DRAWINGS

FIG. 7 is a table showing the results of the investigation conducted on quality of image depending on a difference in amount of intrusion of a developing roller into the photosensitive belt in the first embodiment of the present invention;

DETAILED DESCRIPTION OF THE INVENTION

Figure 1:
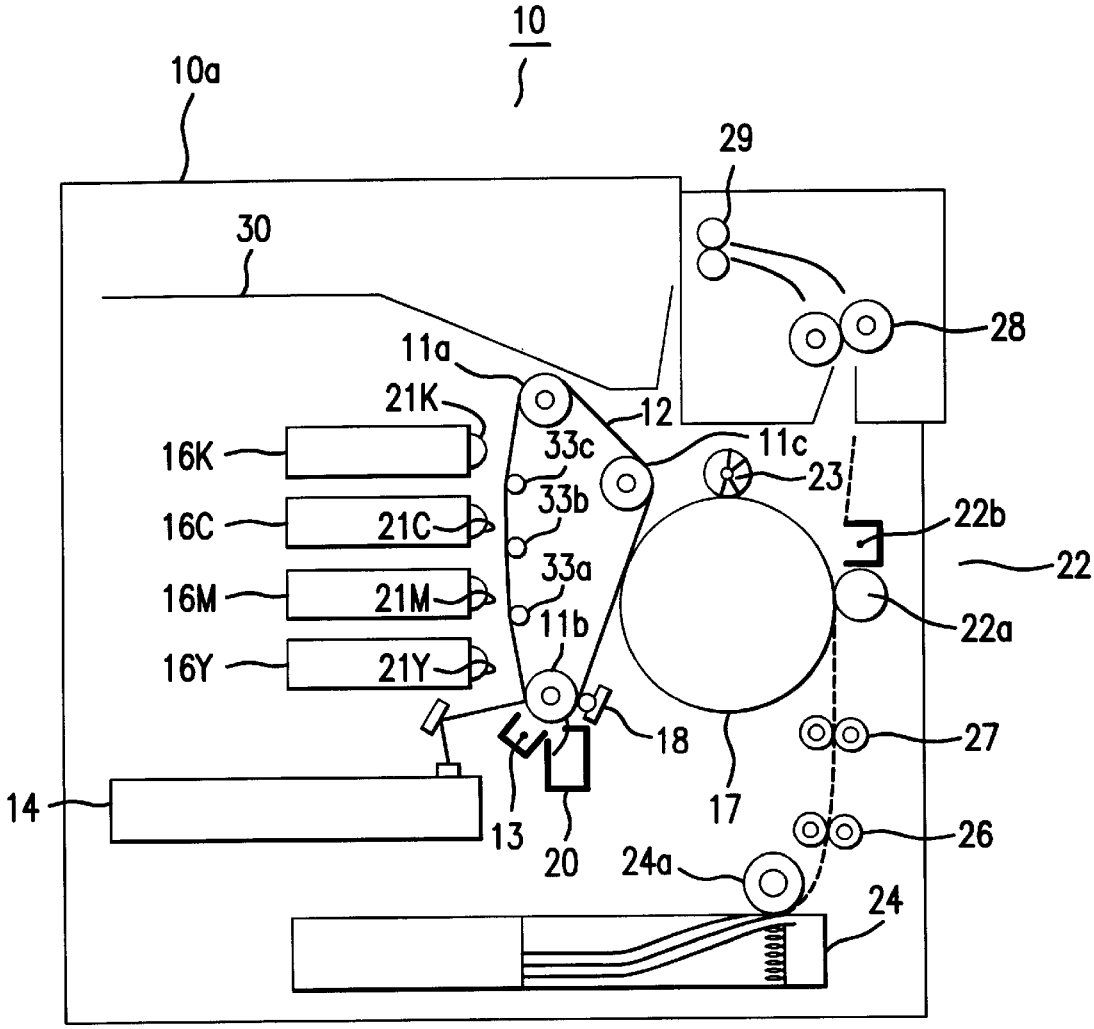
FIG. 1 is a schematic diagram showing an image forming apparatus in a first embodiment of the present invention.

Embodiments of the present invention will be described below in detail referring to the attached drawings. First, a first embodiment of this invention will be described. FIG. 1 is a schematic diagram showing an image forming apparatus 10 such as a color printer, etc. in the first embodiment of this invention. The image forming apparatus 10 is provided with a photosensitive belt 12 which is an image carrier put over a driving roller 11*a*, a driven roller 11*b* and a tension roller 11*c*. The driving roller 11*a*, the driven roller 11*b* and the tension roller 11*c* has a rubber layer surface, respectively so as not to cause the slip with the photosensitive belt 12. The tension roller 11*c* is movable by the spring force of the spring 15, adjusts the tension applied to the photosensitive belt 12 and prevents slip, distortion caused on the photosensitive belt when running. The photosensitive belt 12 is made of a polyethylene terephthalate (PET) with a sensitizer coated on its surface, its back surface is grounded at 0V and is traveled in the arrow direction n.

Around the photosensitive belt 12, there are provided a charger 13 for uniformly charging the photosensitive belt 12 to about −700V according to its running direction, a laser writing unit 14 that is a latent image forming portion for forming a latent image on the charged photosensitive belt 12, developing devices 16Y, 16M, 16C, 16K which are filled with 4 color non-magnetic one-component toners; Yellow (Y), Magenta (M), Cyan (C) and Black (K), an intermediate transferring drum 17, a charge eliminating lamp 18 and a cleaner 20.

At the position opposite to the photosensitive belt 12 in the area wherein the back of the belt 12 is wound round and supported by a driving roller 11*a* that is a supporting member, a two-component developing device 17 is arranged. This device is a second developing device and filled with a two-component developer 17*a* that is composed of a magnetic carrier and a non-magnetic black (K) toner that is a two-component developer. In addition, at the downstream side in the rotating direction of the photosensitive belt 12, an intermediate transferring drum 18 that is rotated in the arrow direction m, a charge eliminating lamp 20 and a cleaning device 21 are arranged.

The laser writing unit 14 forms a latent image on the photosensitive belt 12 by applying the laser beam corresponding to writing signals for respective colors according to image information input from an external computer terminal, etc. At this time, the laser beam emitted from the laser writing unit 14 is applied to the photosensitive belt 12 in the area wherein it winds round the driven roller 11*b* and supported by the driven roller 11*b* and stably traveled. The developing devices 16Y–16K have developing rollers 21Y, 21M, 21C and 21K in diameter 18 mm, which are developing members for developing images by contacting the photosensitive belt 12. Around The intermediate transferring drum 18, there are a secondary transferring roller 22*a* for secondary transferring a toner image transferred from the photosensitive belt 12 on a recording paper, a secondary transferring unit 22 having a separation charger 22*b*, and a drum cleaner 23.

Under the image forming apparatus 10, a paper feed cassette 24 containing recording paper is arranged, and between the paper feed cassette 24 and the secondary transferring roller 22, there are arranged a conveying roller 26 for conveying a recording paper picked up by a pick-up roller 27 from the paper feed cassette 24 to the secondary transferring position, and an aligning roller 30 for synchronizing the leading edge of a recording paper with the edge of a toner image on the secondary transferring unit 22. Further, at the downstream side of the secondary transferring roller 22, a heat roller 31, a paper exit roller 32 and a paper exit portion 30 are provided.

On the backs of the developing devices 16Y–16K, which are not the developing rollers 21Y–21K sides, eccentric cams 31Y, 31M, 31C and 31K which are developing device moving member and independently rotated and driven, respectively, are kept in contact and moving springs 32Y, 32M, 32C and 32K, which are developing device moving members and one ends of which are mounted to the housing 10*a* of the image forming apparatus 10 force the developing devices 16Y–16K in the direction separating from the photosensitive belt 12 are mounted. By the movement of these eccentric cams 31Y–31K and the force of the moving springs 32Y–32K, the developing devices 16Y–16K are slid and the developing rollers 21Y–21K and the photosensitive belt 1*w* are brought in contact or separated each other.

On the inner surface of the photosensitive belt 12, first through third back-up rollers 33*a*, 33*b*, 33*c*, which are supporting members, are provided in contact with the belt. The back-up rollers 33*a*–33*c* are positioned in the intermediate area of the nip portion that is 4 points of contacting area between the photosensitive belt 12 and the developing rollers 21Y–21K, and the photosensitive belt 12 is supported by springs 34*a*, 34*b*, 34*c* so as to be able to oscillate. Thus, the back-up rollers 33*a*–33*c* adjust pressure generated at the nip portion between the developing rollers 21Y–21L and the photosensitive belt 12 and change in tensile force applied to the photosensitive belt 12.

Next, the full color image forming process according to the image forming apparatus 10 will be described. Before starting the image forming, as the short directions of the eccentric cams 31Y–31K are in contact with the developing devices 16Y–16K, the developing devices 16Y–16K are forced by the moving springs 32Y–32K in the direction leaving from the photosensitive belt 12 and the developing rollers 21Y–21K are separated from the photosensitive belt 12.

Figure 5:
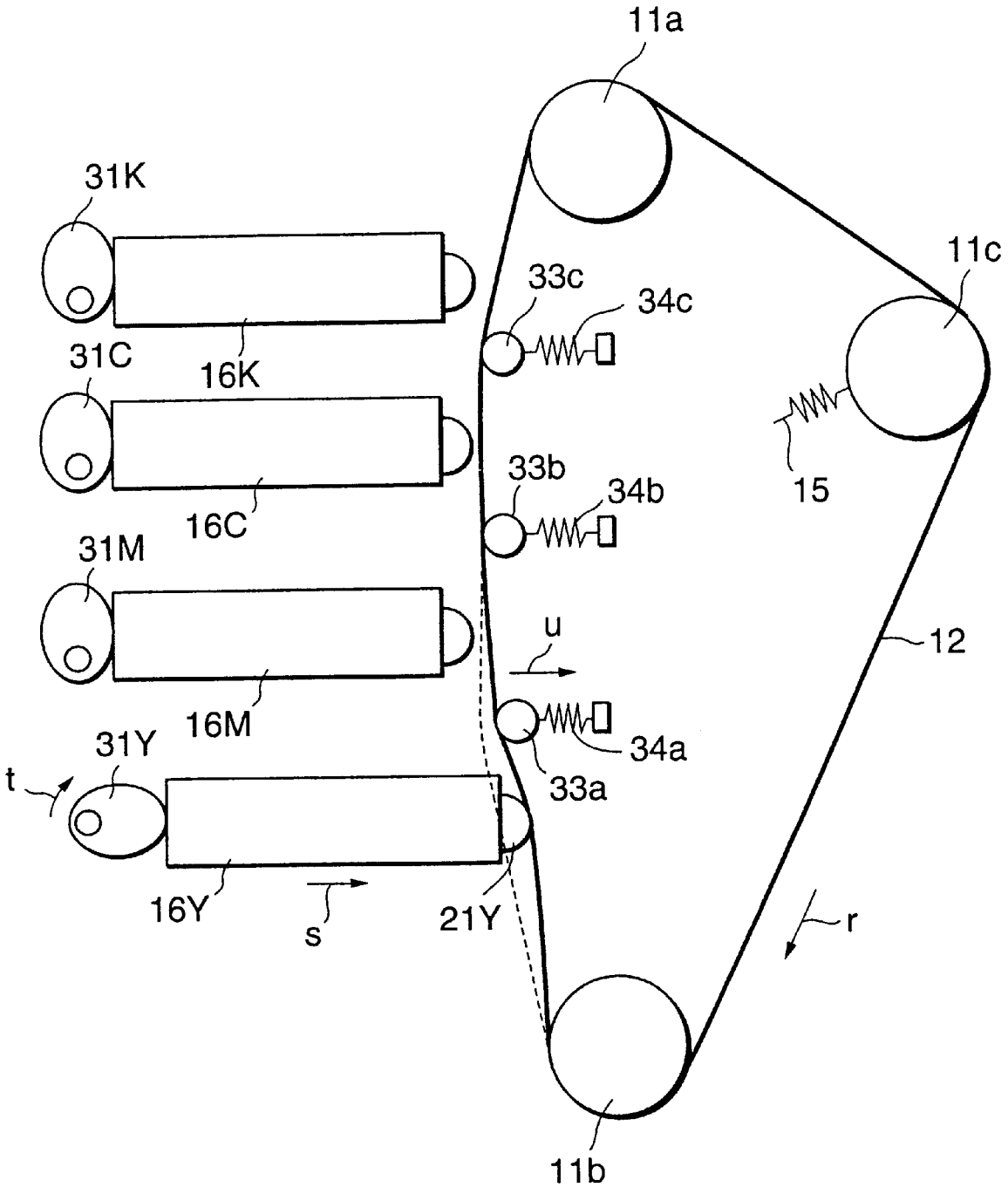
FIG. 5 is an explanatory diagram schematically showing the state an yellow (Y) developing device brought in contact with the photosensitive belt in the first embodiment of the present invention.

When the color image forming process starts in this state, the eccentric cam 31Y for moving the yellow (Y) developing device 16Y filled with a yellow (Y) toner is rotated by 90° in the arrow direction t by the driving device (not illustrated) As a result, the yellow (Y) developing device 16Y is slid and moved in the arrow direction s along a guide (not illustrated) and the developing roller 21Y is brought in contact with the photosensitive belt 12 so as to intrude into it by about 0.5 mm. As a result, the photosensitive belt 12 travels a longer distance between the driven roller 11*b* and the driving roller 11*a* than that when the developing roller 21Y is separated and the tensile force applied to the photosensitive belt 12 increases. At this time, however, a first back-up roller 33*a* supporting the photosensitive belt 12 a the downstream side from the developing roller 21Y is oscillated in the arrow direction u by the contraction of the spring 34*a* corresponding to the tensile force of the photosensitive belt 12 that is changed by the contacting force of the photosensitive belt 12 and the developing roller 21Y and with this, the photosensitive belt 12 is moved from the position shown by the dotted line to the position shown by the solid line in FIG. 5.

As a result, the change amount of running distance of the photosensitive belt 12 generated between the driven roller 11*b* and the driving roller 11*a* is relieved, the change in the tensile force applied to the photosensitive belt 12 is also relieved and the pressure at the nip portion between the developing roller 21Y and the photosensitive belt 12 is prevented from becoming excessively large.

Further, the relation between the amount of intrusions of the developing rollers 21Y–21K into the photosensitive belt 12 at the time of development and the developed image quality was investigated with the results shown on (Table 1) in FIG. 7. From this result, when the amount of intrusion of the developing rollers 21Y–21L into the photosensitive belt 12 is large, the tensile force of the photosensitive belt 12 cannot be adjusted by the back-up rollers 33*a*–33*c* and the springs 34*a*–34*c* and the fluctuation in the tensile force applied to the photosensitive belt 12 when the developing rollers 21Y–21K are separated from the photosensitive belt 12 and when they are in contact with the photosensitive belt 12 becomes large. Accordingly, the relative speed between the developing rollers 21Y–21K and the photosensitive belt 12 changes, image quality is deteriorated by the improper development and further, improper image results from insufficient expansion of image or color deviation of toner image caused from the fluctuation in running speed of the photosensitive belt 12.

On the other hand, when the amount of intrusion of the developing rollers 21Y–21K into the photosensitive belt 12 is small, it is difficult to obtain uniform amount of intrusion of the developing rollers 21Y–21K into the photosensitive belt 12 for overall length in the main scanning direction and in particular, an uneven density tends to cause at the ends of the developing rollers 21Y–221K and image quality drops. Further, to make the amount of intrusion of the developing rollers 21Y–21K into the photosensitive belt 12 uniform, the assembling accuracy is improved but it is restricted from the viewpoint of manufacturing cost. From the above-mentioned aspects, an adequate amount of intrusion of the developing rollers 21Y–21K into the photosensitive belt 12 is considered to be about 0.5–1.0 mm.

Under this state, the photosensitive belt 12 runs in the arrow direction r and with the running, it is uniformly charged to −700V by the charger 13 and is applied with laser beam corresponding to the yellow image signal out of the image signals separated into yellow, magenta, cyan and black by the laser writing unit 14. Thus, an yellow latent image of about −100V at the laser beam applied portion is formed on the photosensitive belt 12. Then, the yellow latent image on the photosensitive belt 12 is developed by the developing roller 21Y while passing through the nip portion between the developing roller 21Y and the photosensitive belt 12 and an yellow toner image is formed on the photosensitive belt 12.

Then, the photosensitive belt 12 reaches the intermediate transferring drum 17 where about +1 kV transferring bias is applied and the yellow toner image is intermediately transferred on the intermediate transferring drum electrostatically. After the intermediate transferring, the surface charge of the photosensitive belt 12 is eliminated by the charge eliminating lamp 18 and the cleaner 20 cleans residual toner.

Thereafter, likewise the yellow toner image forming processing, the magenta, cyan and black toner image forming processes are repeated and further, yellow (Y), magenta (M), cyan (C) and black (K) toner images are transferred and laminated in order and a full color toner image is formed on the intermediate transferring drum 17.

Figure 2:
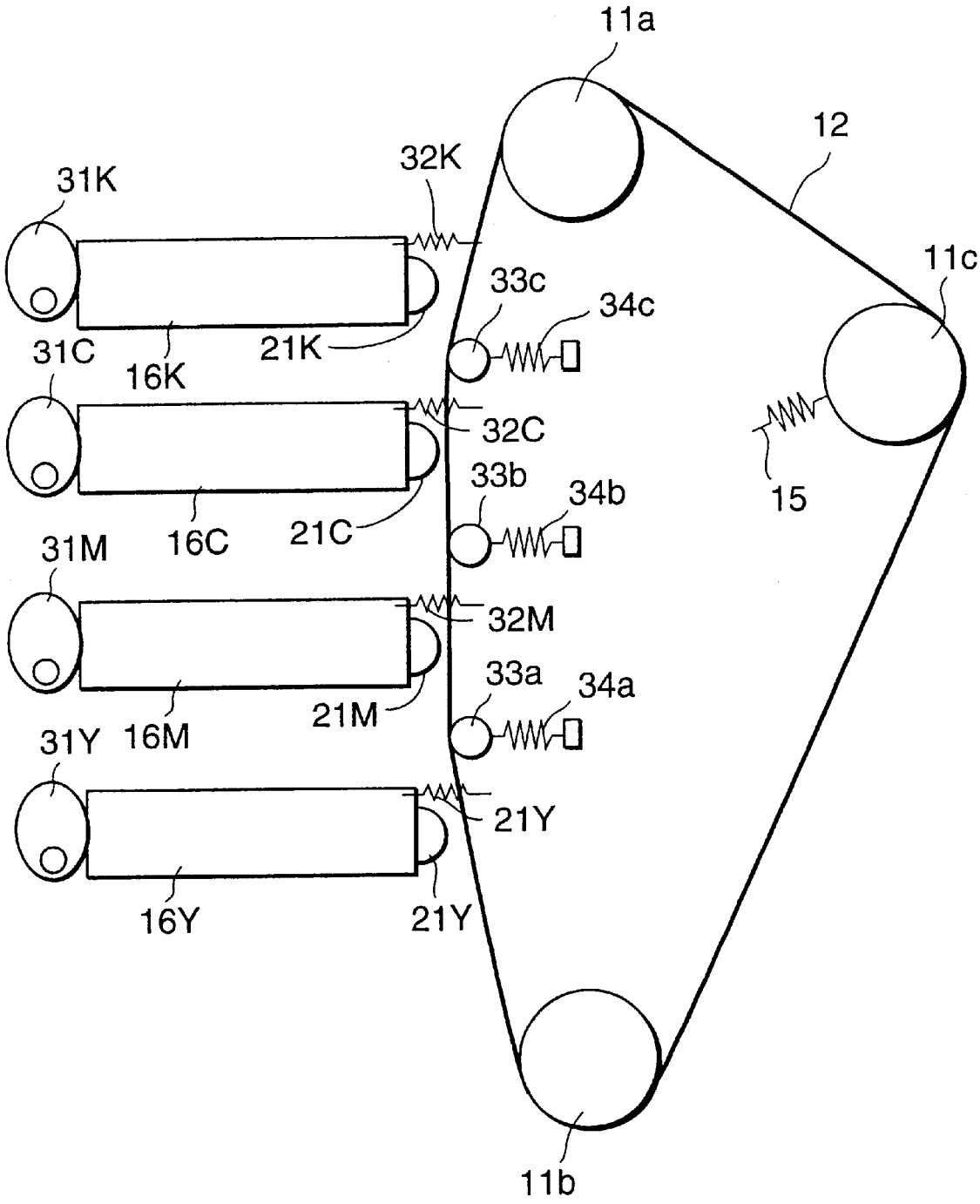
FIG. 2 is a schematic diagram showing a photosensitive belt and developing devices in a first embodiment of the present invention.
Figure 3:
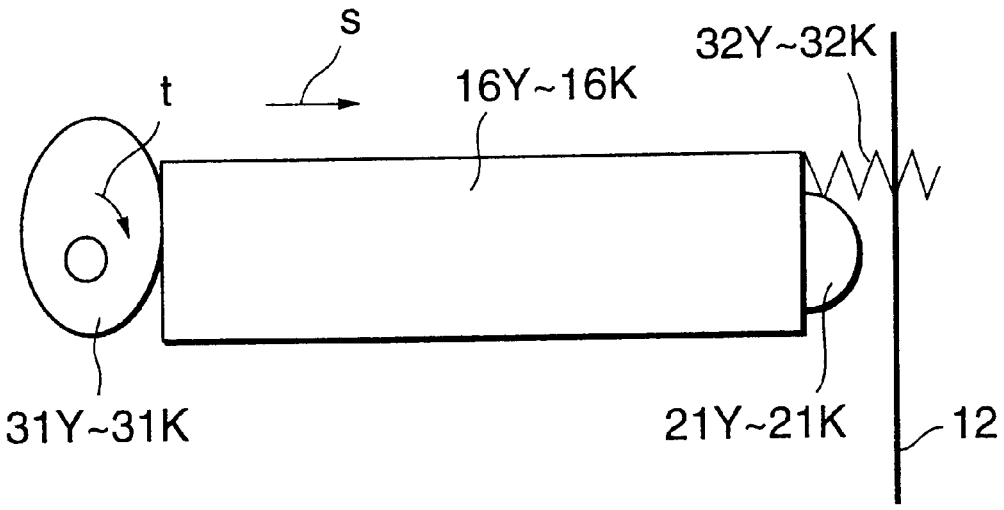
FIG. 3 is an explanation diagram schematically showing the state of a developing roller separated from the photosensitive belt in the first embodiment of the present invention.
Figure 4:
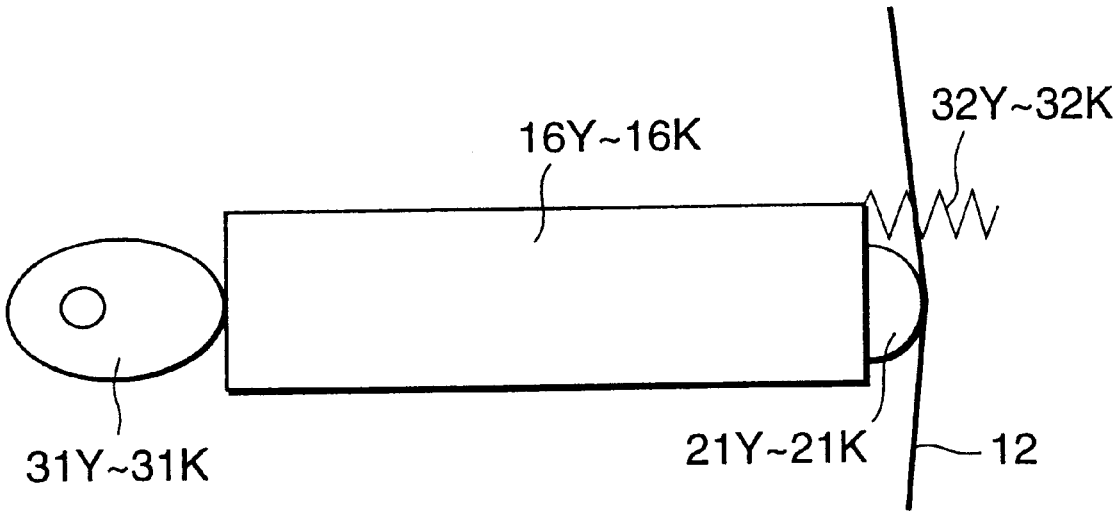
FIG. 4 is an explanatory diagram schematically showing the state of the developing roller brought in contact with the photosensitive belt in the first embodiment of the present invention.

However, when the yellow toner image forming process is completed, the eccentric cam 31Y is rotated by 90° and moved in the direction reverse to the arrow direction s, and when the short direction shown in FIG. 3 contacts the developing device 16Y, the eccentric cam 31Y stops and the yellow developing device 16Y is moved in the direction reverse to the arrow direction s leaving from the photosensitive belt 12 by the force of the moving spring 32Y, and the developing roller 21Y is separated from the photosensitive belt 12. As a result, the back-up roller 33*a* returns to the original position shown in FIG. 2.

Figure 6:
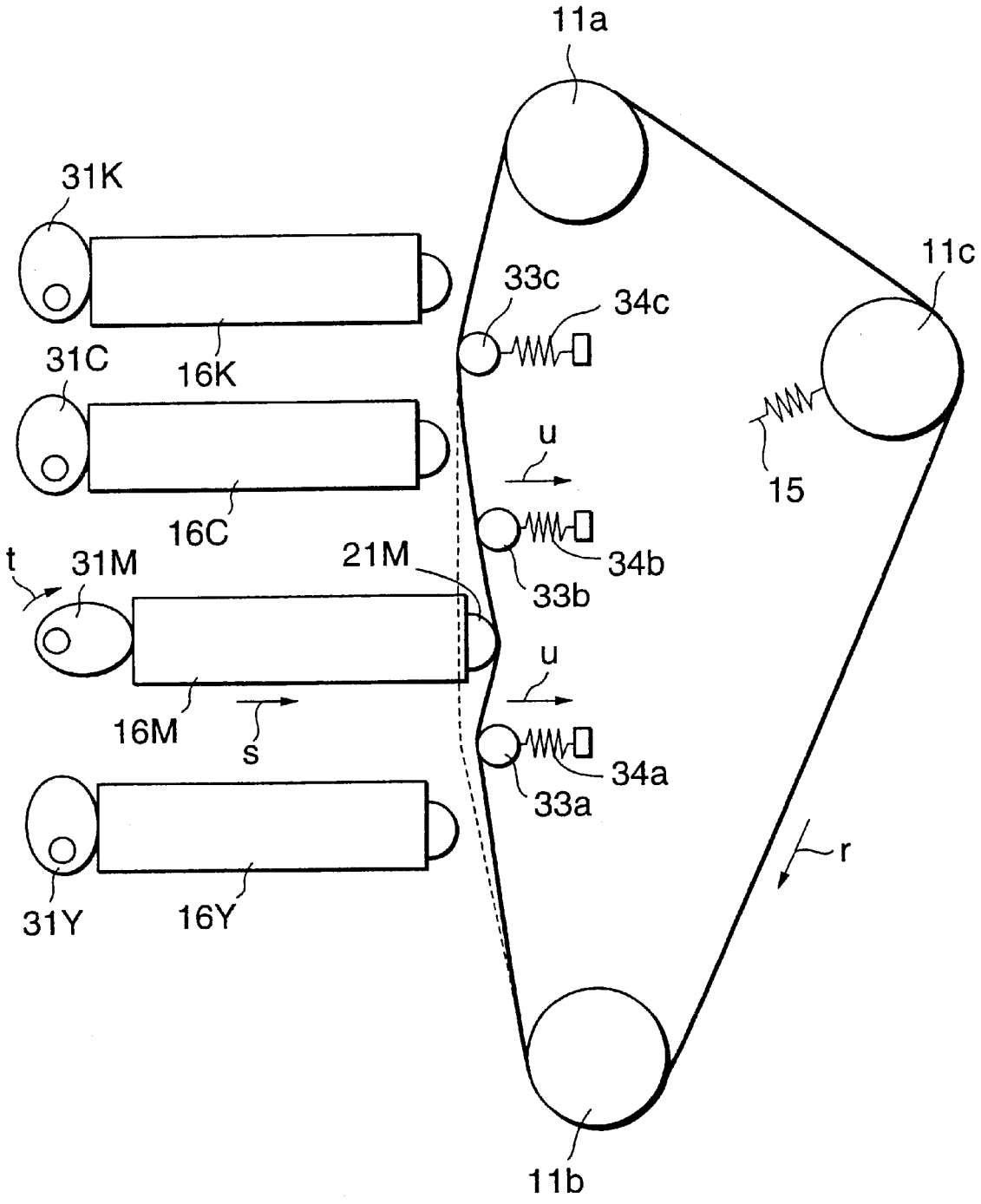
FIG. 6 is an explanatory diagram schematically showing the state of a magenta (M) developing device brought in contact with the photosensitive belt in the first embodiment of the present invention.

Then, for the magenta toner image forming process, the eccentric cam 31M is rotated by 90° and moved in the arrow direction to slide and move the magenta (M) developing device 16M in the arrow direction s and contacts the developing roller 21M to intrude into the photosensitive belt 12 by about 0.5 mm. At this time, the tensile force applied to the photosensitive belt 12 becomes high. However, the first back-up roller 33*a* provided at the upstream side of the developing roller 21M for supporting the photosensitive belt 2 and the second back-up roller 33*b* provided at the downstream side of the developing roller 21M for supporting the photosensitive belt 12 are moved in the arrow direction u by the contraction of the springs 34*a*, 34*b* corresponding to the tensile force of the photosensitive belt 12 that is fluctuated by the contacting force of the photosensitive belt 12 and the developing roller 21M, and with this, the photosensitive belt 12 is moved from the position shown by the dotted line to the position shown by the solid line in FIG. 6. Accordingly, the amount of change in the running distance between the driven roller 11*b* and the driving roller 11*a* of the photosensitive belt 12 is relieved and the change in the tensile force applied to the Photosensitive belt 12 is also relieved.

When the photosensitive belt 12 with a magenta latent image by the charger 13 and the laser writing unit 14 passes through the nip portion between the developing roller 21M and the photosensitive belt 12 under this state, the latent image is developed by the magenta (M) toner and a magenta toner image is formed on the photosensitive belt 12. Hereafter, similarly the cyan (C) developing device 16C and black (K) developing device 16K are brought in contact with the photosensitive belt 12 in order and a cyan and black toner images are formed in order on the photosensitive belt 12.

When the developing rollers 21Y–21K contact and intrude into the photosensitive belt 12 during this period and the tensile force applied to the photosensitive belt 12 increases, the back-up rollers 33*a*–33*c* provided either at the upper stream side or the downstream side of the developing rollers 21Y–21K oscillate according to a size of the tensile force of the photosensitive belt 12 that fluctuates by the contacting force of the photosensitive belt 12 and the developing rollers 21Y–21K, and the tensile force of the photosensitive belt 12 is relieved and adjusted.

On the other hand, yellow (Y), magenta (M), cyan (C) and black (K) full color images formed on the intermediate transferring drum 17 are collectively transferred on a recording paper that is taken out of the paper supply cassette 24 and conveyed synchronous with the full color toner images by the secondary transferring unit 22 to which 2–3 kV bias voltage is applied. Then, this recording paper is heated by the heat roller 28 to fix full color toner images, ejected on the exit tray via the exit roller 29 and a full color image is completed on the recording paper. During this period, the intermediate transferring drum 17 is cleaned by the drum cleaner 23 by removing residual toner with a brush applied with +1.5 kV bias voltage and becomes ready to next intermediate transfer.

According to this first embodiment, as the developing rollers 21Y–21K are made in a small diameter, the tensile force applied to the photosensitive belt 12 increases when the developing rollers 21Y–21K intrude into the photosensitive belt 12 in order to take a sufficient nip width. The back-up rollers 33*a*–33*c* supporting the photosensitive belt 12 elastically at least either at the upper stream side or the downstream side from the developing rollers 21Y–21K oscillate and the photosensitive belt 12 is moved accordingly and the tensile force is relieved.

Accordingly, a large pressure applied to the nip portion between the photosensitive belt 12 and the developing rollers 21Y–21K can be prevented and fluctuation of the relative speed between the photosensitive belt 12 and the developing rollers 21Y–21K also can be prevented, and a good toner image is obtained by the stabilized development characteristic. Further, the amount of tensile force applied to the photosensitive belt 12 varying when the developing rollers 21Y–21K are separated from the photosensitive belt 12 and when they are in contact with the belt is relieved and the change in running speed of the photosensitive belt 12 can be prevented. In turn, a good color image is obtained without causing an expansion or contraction of a formed image or color deviation of toner images in respective colors.

Next, a second embodiment of the present invention will be described. This second embodiment is to adjust pressure when the photosensitive belt contacts the developing rollers and the tensile force of the photosensitive belt by using a back-up board made of an elastic member instead of the elastic back-up rollers in the first embodiment. Accordingly, in this second embodiment, the same component elements as those described in the first embodiments will be assigned with the same reference numerals and the detailed explanations of them will be omitted.

Figure 8:
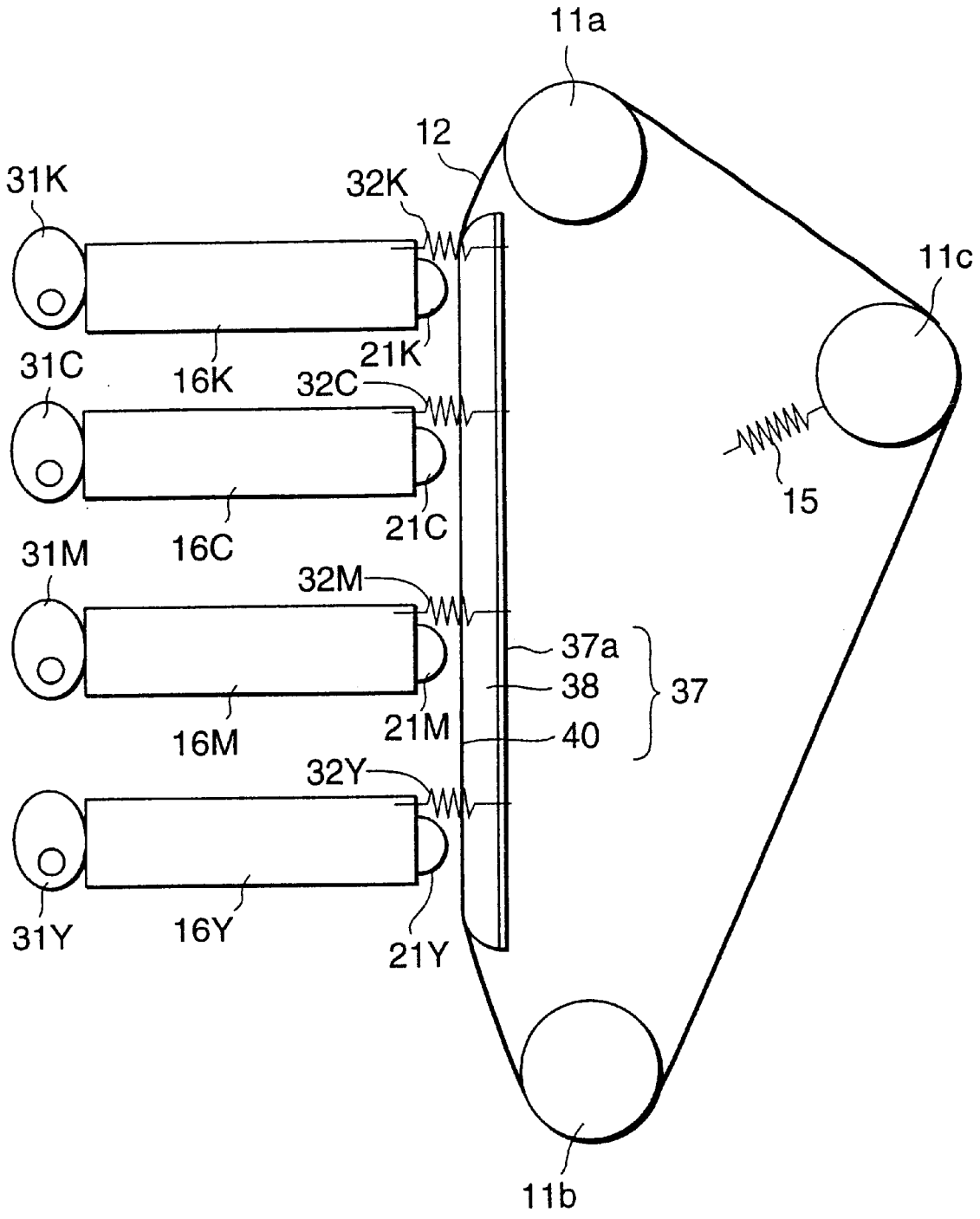
FIG. 8 is a schematic diagram showing the photosensitive belt and developing devices in a second embodiment of the present invention.

As shown in FIG. 8, the back-up board 37 that is a supporting member is kept in contact with the inner surface opposite to the surface of the photosensitive belt 12 contacting the developing devices 16Y–16K at a certain pressure. The photosensitive belt 12 is set to have a certain tensile force by contacting this back-up board 37. The back-up board 37 is formed in a size capable of supporting the nip portion between all the developing devices 16Y–16K and the photosensitive belt 12. An elastic board 38 made of, for instance foam urethane or ethylene propylene rubber (EPDM), etc. is pasted on a solid board 37*a* and further, the surface of the elastic board 38 is provided with a surface layer 40 made of, for instance, a silicon sheet for reducing friction with the photosensitive belt 12. Thus, the back-up board 37 adjusts the pressure produced on the nip portion between the developing rollers 21Y–21K and the change in the tensile force applied to the photosensitive belt 12.

Figure 9:
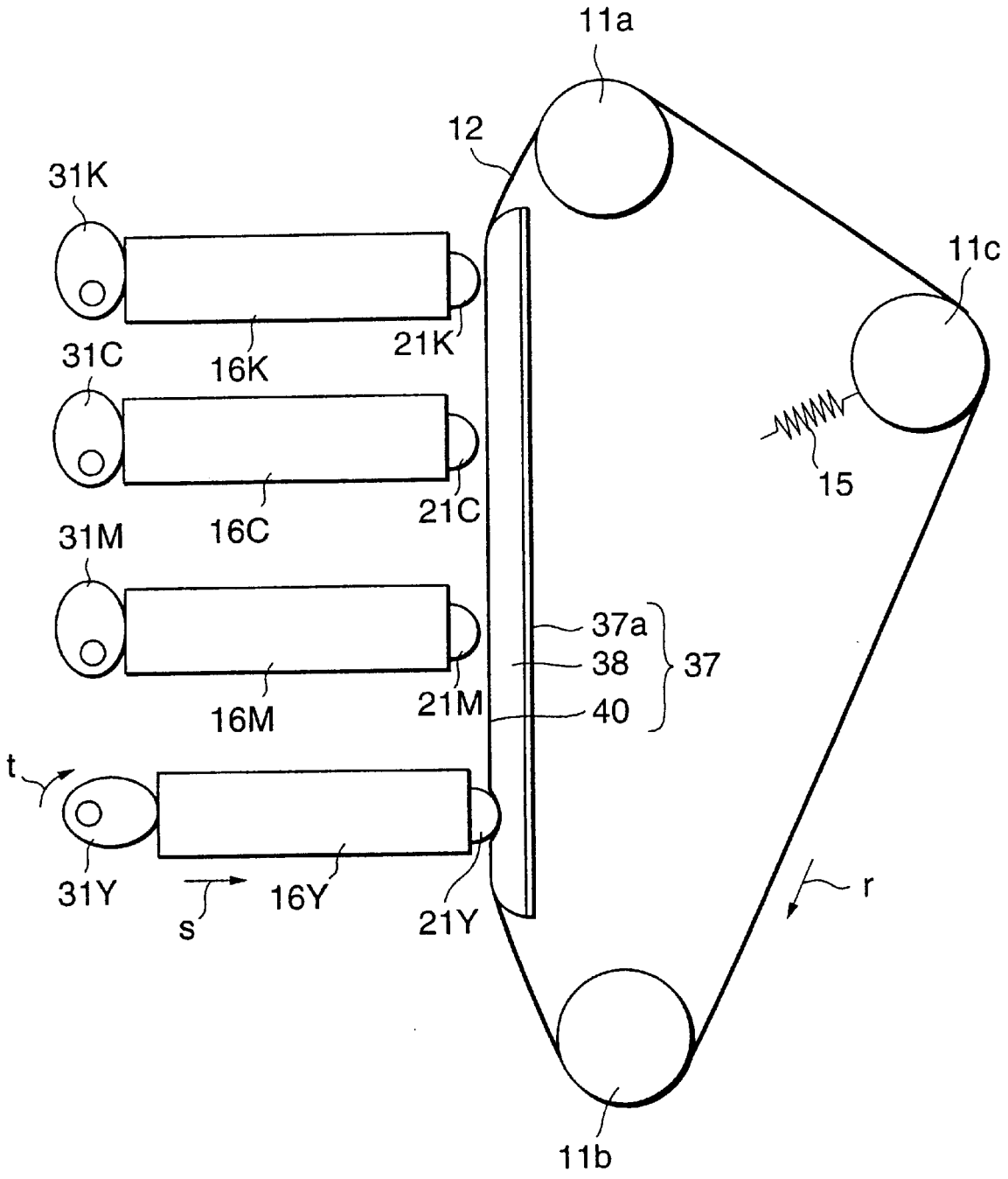
FIG. 9 is an explanatory diagram schematically showing the yellow (Y) developing device brought in contact with the photosensitive belt in the second embodiment of the present invention.

The developing rollers 21Y–21K are brought in contact with the photosensitive belt 12 supported by such the back-up board 37 so as to intrude into it by about 0.5 mm when contact as shown in FIG. 9. When the relation between the amount of intrusion of the developing rollers 21Y–21K into the photosensitive belt 12 and the quality of image at the time of development was investigated with the same results as those shown on (Table 1) in FIG. 7 in the first embodiment.

From this result, when the amount of intrusion of the developing rollers 21Y–21K into the photosensitive belt 12 is large, a difference in the running length of the photosensitive belt 12 from the driven roller 11*b* to the driving roller 11*a* when the developing rollers 21Y–21K are separated therefrom becomes larger than that when the developing rollers 21Y–21K are intruding into the belt. Further, the friction between the photosensitive belt 12 and the back-up board 37 becomes large as a result of increase in the nip between the developing rollers 21Y–21K and the photosensitive belt 12 and the driving torque of the photosensitive belt 12 increases. As a result, the running speed of the photosensitive belt 12 changes and in turn, improper image is produced for expansion and contraction of images and/or deviation of respective toner image colors.

On the other hand, when the amount of intrusion of the developing rollers 21Y–21K into the photosensitive belt 12 is small, it becomes difficult to obtain the uniform amount of intrusion of the developing rollers 21Y–21K into the photosensitive belt 12 on the overall surface in the main scanning direction likewise the first embodiment and the quality of images drops for uneven density in the main scanning direction. From the results described above, an adequate amount of intrusion of the developing rollers 21Y–21K into the photosensitive belt 12 is regarded to be 0.5–1.0 mm.

Next, the developing process by the developing devices 16Y–16K will be described. As shown in FIG. 8, before starting the image formation, the developing devices 16Y–16K are forced by the moving springs 32Y–32K in the direction to separate from the photosensitive belt 12 and the developing rollers 21Y–21K are kept separated from the photosensitive belt 12. Then, when the image forming process starts, the eccentric cam 31Y is rotated by 90° and driven in the arrow direction t and the yellow (Y) developing device 16Y is slid and moved in the arrow direction s, the developing roller 21Y is brought in contact with the photosensitive belt 12 so as to intrude into it by about 0.5 mm and a sufficient nip portion is secured.

Figure 10:
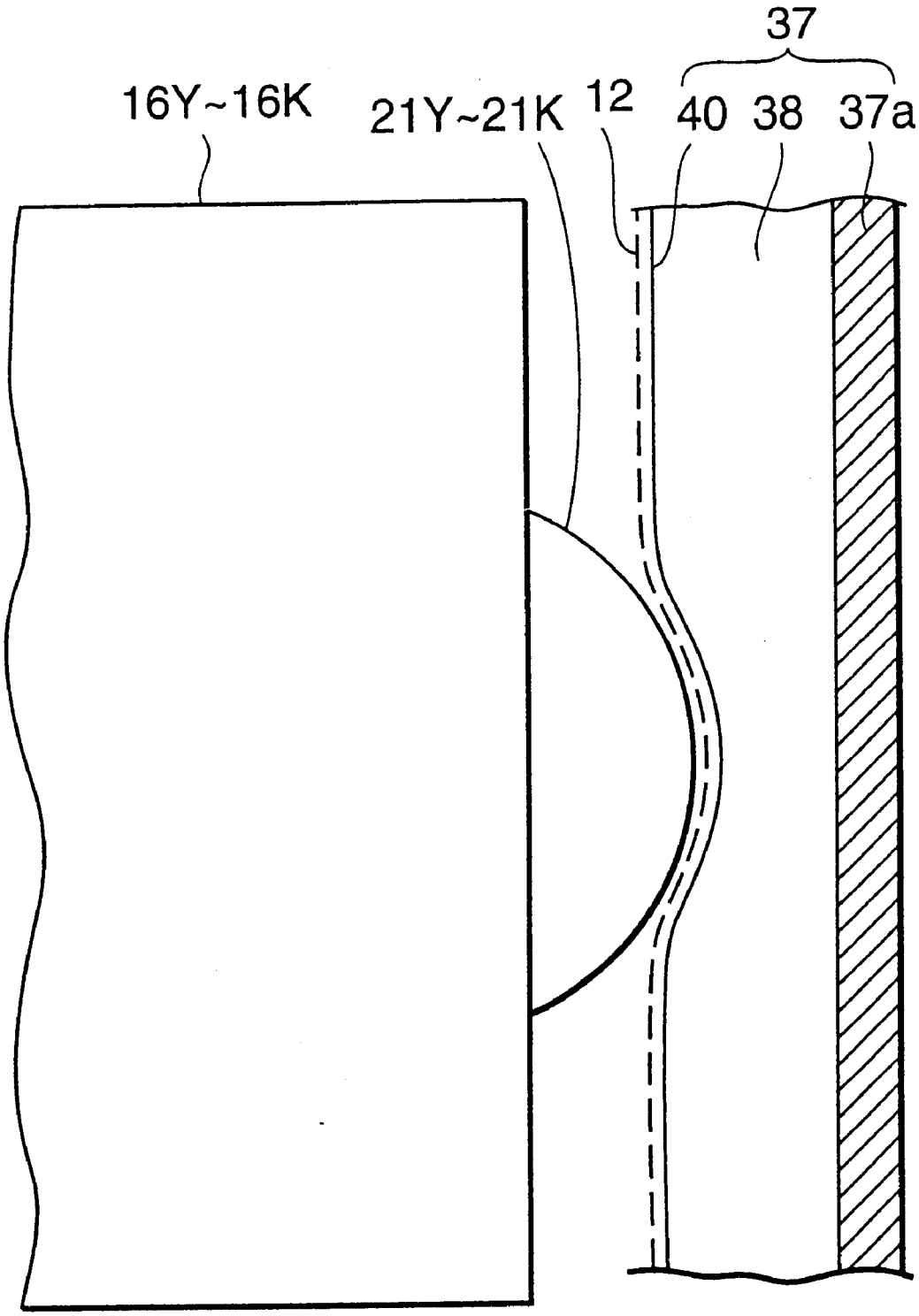
FIG. 10 is an explanatory diagram schematically showing the state of the developing roller brought in contact with the photosensitive belt in the second embodiment of the present invention.

At this time, corresponding to the contacting force produced on the nip portion between the developing roller 21Y and the photosensitive belt 12, the elastic board 38 is contracted, the photosensitive belt 12 moves from a position shown by the dotted line to the position to bend along the shape of the developing roller 21Y shown by the solid line in FIG. 10, and the pressure applied to the photosensitive belt 12 at the nip portion is reduced.

Under this state, the photosensitive belt 12 is run in the arrow direction r and an yellow latent image is formed corresponding to an yellow image signal through the charger 13 and the laser writing unit 14. Then, the yellow latent image formed on the photosensitive belt 12 is developed by the developing roller 21Y while it passes through the nip portion between the developing roller 21Y and the photosensitive belt 12 and an yellow toner image is formed on the photosensitive belt 12.

Then, after the yellow toner image is intermediately transferred on the intermediate transferring drum 17, the similar toner image forming process is repeated and magenta, cyan and black toner images are formed on the photosensitive belt 12 in order and further, the yellow (Y), magenta (M), cyan (C) and black (K) toner images are sequentially transferred and laminated.

When the yellow toner image forming process is completed, the yellow developing device 16Y is separated from the photosensitive belt 12 by the spring force of the moving spring 32Y. As a result, the deflection of the back-up board 37 produced at a position opposite to the yellow developing device 16Y is restored to the original plane state. Then, the magenta (M) developing device 16M is slid and the developing roller 21M is brought in contact with the photosensitive belt 12 so as to intrude into it by about 0.5 mm. The elastic board 38 is contracted corresponding to the contacting force generated on the nip portion between the developing roller 21M and the photosensitive belt 12 at this time, the photosensitive belt 12 is moved to the position to bend along the shape of the developing roller 21M and the pressure applied to the photosensitive belt 12 is reduced at the nip portion.

When the photosensitive belt 12 with a magenta latent image formed passes through the nip portion between the developing roller 21M and the photosensitive belt 12 under this state, the latent image is developed by the magenta (M) toner and a magenta toner image is formed on the photosensitive belt 12. Hereafter, the cyan (C) developing device 16C and the black (K) developing device 16K are brought in contact with the photosensitive belt 12 in order, and after forming cyan and black toner images are formed in order on the photosensitive belt 12, the images are transferred to the intermediate transferring drum 17 and full color toner images are formed.

The yellow (Y), magenta (M), cyan (C) and black (K) full color toner images formed on the intermediate transferring drum 17 are collectively transferred on a recording paper by the secondary transferring unit 22 likewise the first embodiment, and fixed by the heat roller 28, ejected on the exit tray 30 and the full color image is completed on the recording paper.

According to the second embodiment, as the developing rollers 21Y–21K are made small in diameter, when the developing rollers 21Y–21K are intruded into the photosensitive belt 12 in order to get a sufficient nip width, the elastic board 38 is contracted corresponding to the contacting force produced on the nip portion between the developing roller 21Y–21K and the photosensitive belt 12, the photosensitive belt 12 is bent according to the shape of the developing rollers 21Y–21K and the pressure applied to the photosensitive belt 12 is reduced.

Accordingly, the developing roller 21Y and the photosensitive belt 12 do not cause a change in relative speed that is produced by a large pressure applied to the nip portion and the image developing process can be carried out at a prescribed difference in relative speed, developing characteristic is stabilized and a good toner image is obtained. Further, a torque required for driving the photosensitive belt 12 can be reduced by the reduced pressure at the nip portion and the photosensitive belt 12 can be run stably at a prescribed running speed and in turn, without causing expansion and contract of formed images or deviation in respective color toner images, a color image of good quality is obtained. Furthermore, the whole surface of the nip portion between the developing rollers 21Y–21K and the photosensitive belt 12 is supported elastically by the back-up board 37, the photosensitive belt 12 is run more stably without causing a twist or waviness and an image of good quality is obtained.

Next, a third embodiment of the present invention will be described. In this embodiment, the developing rollers are provided stationary and the pressure when the photosensitive belt is brought in contact with the developing devices and the tensile force of the photosensitive belt produced in the first embodiment are adjusted by bringing the developing rollers and the photosensitive belt in contact with each other or separating them by moving the photosensitive belt by the elastic back-up member. Accordingly, in this third embodiment, the same component elements as those described in the first embodiment will be assigned with the same reference numerals and the detailed explanation of them will be omitted.

Figure 11:
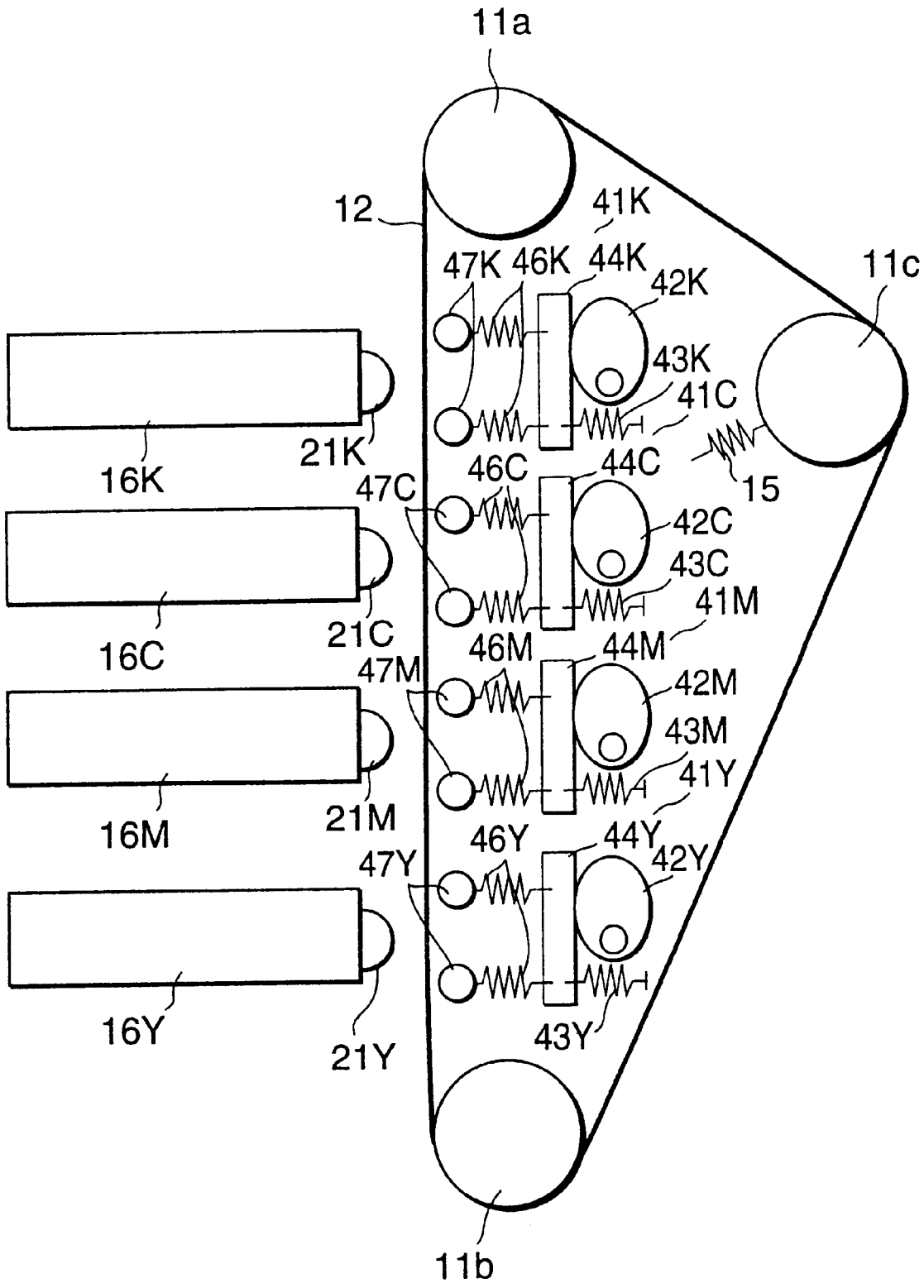
FIG. 11 is a schematic diagram showing the photosensitive belt and developing devices in a third embodiment of the present invention.

As shown in FIG. 11, at the positions of inner surface opposing to the developing rollers 21Y–21K, contacting the developing devices 16Y–16K of the photosensitive belt 12, there are provided the first through fourth back-up members 41Y, 41M, 41C, 41K, which are the supporting members. The developing devices 16Y–16K are arranged stationary in the state separated from the photosensitive belt 12 in the image forming apparatus 10. Eccentric cams 42Y, 42M, 42C, 42K which are photo-conductor moving members and are rotated and driven independently are kept in contact with the backs of the first through fourth backup members. Further, moving springs 43Y, 43M, 43C, 43K which are photo-conductor moving members and one ends are attached to the housing 10*a* of the image forming apparatus 10 force the back-up members 41Y–41K in the direction to leave them from the photosensitive belt 12 are mounted to the back-up members 41Y–41K. By the drive of the eccentric cams 42Y–42K and the spring force of the moving springs 43Y–43K, the back-up members 41Y"41K are slid and moved along the guide (not illustrated) to separate the developing rollers 21Y–21K from the photosensitive belt 12.

The first through fourth back-up members 41Y–41K have back-up roller pairs 47Y, 47M, 47C, 47K supported by, for instance, coil springs 46Y, 46M, 46C, 46K on the substrates 44Y, 44M, 44C, 44K. The back-up roller pairs 47Y–47K have a prescribed space so as to force the photosensitive belt 12 to the developing rollers 21Y–21K side at the upper stream side and the downstream side of the nip portion between the developing rollers 21Y–21K, respectively.

By the driving of the eccentric cams 42Y–42K and the spring force of the moving springs 43Y–43K, moving in the area opposing to the developing devices 16Y–16K, bring the photosensitive belt 12 in contact with the developing rollers 21Y–21K. When the photosensitive belt 12 contacts the developing rollers 21Y–21K, the back-up roller pairs 47Y–47K are oscillated by the springs 46Y–46K and pressure produced at the nip portion between the developing rollers 21Y–21K and change in the tensile force of the photosensitive belt 12 are adjusted. Further, a proper amount of intrusion of the developing rollers 21Y–21K when contacted is regarded to be about 0.5–1.0 mm.

Figure 12:
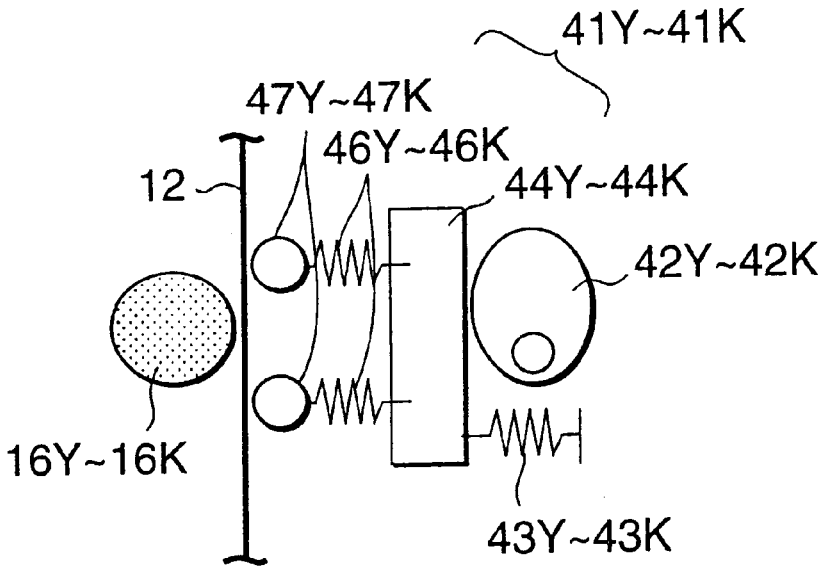
FIG. 12 is an explanatory diagram schematically showing the state of the photosensitive belt separated from the developing roller in the third embodiment of the present invention.
Figure 13:
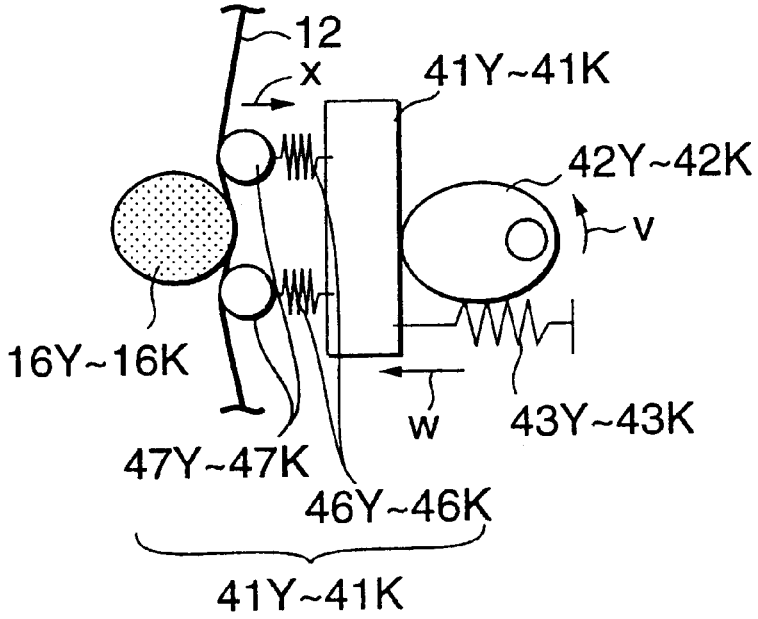
FIG. 13 is an explanatory diagram schematically showing the state of the photosensitive belt brought in contact with the developing roller in the third embodiment of the present invention.
Figure 14:
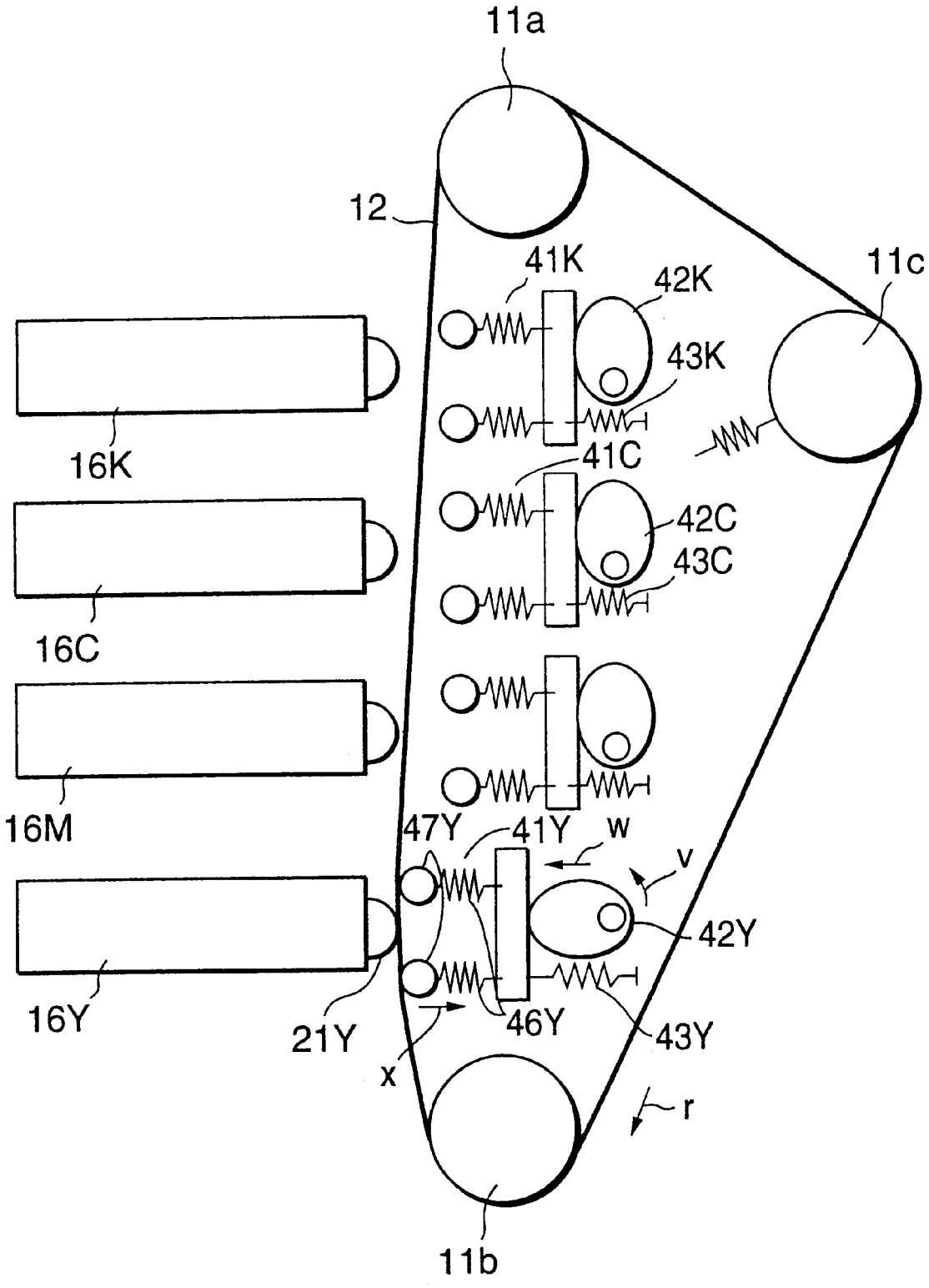
FIG. 14 is an explanatory diagram schematically showing the state of the photosensitive belt brought in contact with the yellow (Y) developing device in the third embodiment of the present invention.
Figure 15:
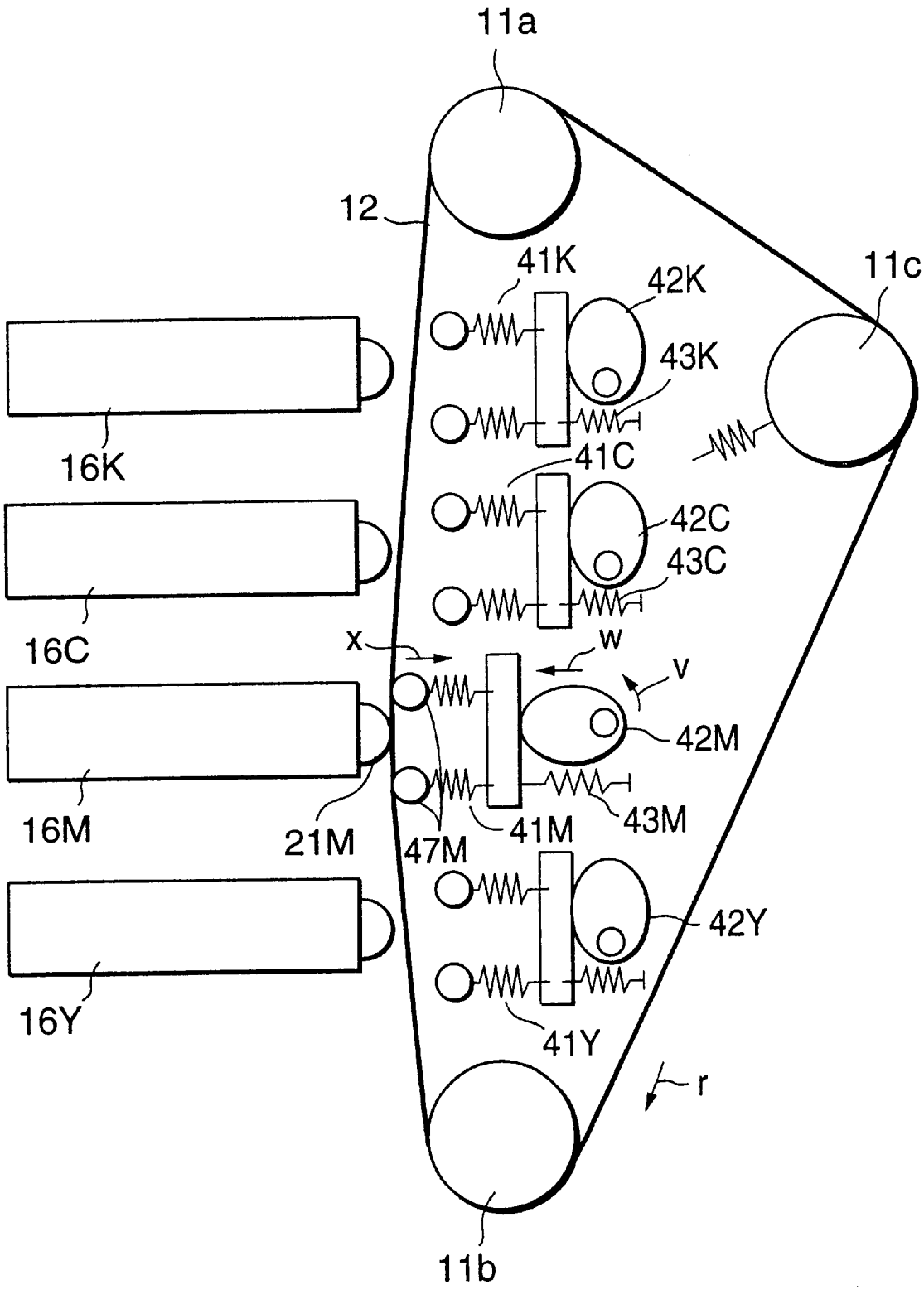
FIG. 15 is an explanatory diagram schematically showing the state of the photosensitive belt brought in contact with the magenta (M) developing device in the third embodiment of the present invention.

Next, the developing process will be described. Before starting the image formation, as shown in FIG. 12, because the short direction of the eccentric cams 42Y–42K is in contact with the substrates 44Y–44K of the back-up members 41Y–41K, the back-up members 41Y–41K are forced to the direction leaving from the photosensitive belt 12 by the moving springs 43Y–43K, and the photosensitive belt 12 is separated from the developing rollers 21Y–21K.

When the image forming process starts, the eccentric cam 42Y is rotated by 90° and driven in the arrow direction v and the first back-up member 41Y is slid and moved in the arrow direction w. Thus, the photosensitive belt 12 is forced out in the direction of the developing roller 21 by the first back-up member 41Y, and the developing roller 21Y contacts the photosensitive belt 12 so as to intrude into it by about 0.5 mm. As a result, a sufficient nip width is secured between the developing roller 21Y and the photosensitive belt 12.

As a result of the contact of the developing roller 21Y with the photosensitive belt 12, the running distance between the driven roller 11*b* and the driving roller 11*a* of the photosensitive belt 12 becomes long and the tensile force applied to the photosensitive belt 12 increases. At this time, however, because of the contraction of the spring 47Y corresponding to the tensile force of the photosensitive belt 12 that is changed by the contacting force of the photosensitive belt 12 with the developing roller 21Y, the back-up roller pair 47 supporting the upper stream side and the downstream side of the developing roller 21Y are oscillated in the arrow direction x, and the photosensitive belt 12 is moved in the arrow direction x to reduce the pressure at the nip portion.

As a result, the change amount of running distance produced between the driven roller 11*b* and the driving roller 11*a* of the photosensitive belt 12 is relieved and the tensile force applied to the photosensitive belt 12 is also relieved.

Accordingly, a large pressure is no longer applied to the nip portion between the developing roller 21Y and the photosensitive belt 12, a relative speed between the developing roller 21Y and the photosensitive belt 12 does not change during the developing operation and the photosensitive belt 12 runs stably at a prescribed running speed.

The photosensitive belt 12 runs in th e arrow direction r under this state and an yellow latent image is formed corresponding to an yellow image signal through the charger 13 and the laser wiring unit 14. Then, the yellow latent image on the photosensitive belt 12 is developed while it passes through the nip portion with the yellow developing roller 21Y, and a yellow toner image is formed on the photosensitive belt 12.

Then, after a yellow toner image is intermediately transferred on the intermediate transferring drum 17, the similar toner image forming process is repeated for forming magenta, cyan and black toner images on the photosensitive belt 12 in order and further, yellow (Y), magenta (M), cyan (C) and black (K) toner images are laminated and transferred on the intermediate transferring drum.

When the yellow toner image forming process is completed, the first back-up member 41Y is separated from the photosensitive belt 12 by the spring force of the moving spring 43Y. As a result, the back-up roller 47 is returned to the original position by the spring 46Y.

Then, similarly to the first back-up member 41, the eccentric cam 42M is rotated and driven in the arrow direction v and a second back-up member 41M is moved in the arrow direction w and the developing roller 21M is brought in contact with the photosensitive belt 12 so as to intrude into it by about 0.5 mm. At this time, according to the tensile force applied to the photosensitive belt 12 that is varied by the contacting force of the photosensitive belt 12 with the developing roller 21M, the back-up roller pair 47M is oscillated, the photosensitive belt 12 is moved in the arrow direction x to reduce the pressure at the nip portion and thus, amount of change in the running distance produced between the driven roller 11*b* and the driving roller 11*a* of the photosensitive belt 12 is relieved and the tensile force applied to the photosensitive belt 12 is also relieved. Accordingly, a large pressure is no longer applied to the nip portion between the developing roller 21M and the photosensitive belt 12, a relative speed between the developing roller 21M and the photosensitive belt 12 does not change in the developing operation and the photosensitive belt 12 runs stably at a prescribed running speed.

When the photosensitive belt 12 with the magenta latent image formed passes through the nip portion between the developing roller 21M and the photosensitive belt 12, the latent image is developed satisfactorily by a magenta (M) toner and a magenta toner image is formed on the photosensitive belt 12. Hereafter, a third or a fourth back-up member 41C or 41K are similarly moved and the photosensitive belt 12 is brought in contact with the developing roller 21C or 21K and cyan and black toner images are formed on the photosensitive belt 12 in order and then, laminated and transferred on the intermediate transferring drum 17 and full color toner images are obtained.

Hereafter, likewise the first embodiment, the full color images formed on the intermediate transferring drum 17 are collectively transferred and fixed on a recording paper and a full color image is obtained.

According to this third embodiment, in order to take a sufficient nip width, when the developing rollers 21Y–21K are intruded into the photosensitive belt 12, the tensile force applied to the photosensitive belt 12 increases. Corresponding to the size of this increased tensile force, the back-up rollers 47Y–47K elastically supporting the photosensitive belt 12 are oscillated and with this, the photosensitive belt 12 is moved and the tensile force is relieved.

Accordingly, a large pressure applied to the nip portion between the photosensitive belt 12 and the developing rollers 21Y–21K can be prevented, the fluctuation of the relative speed between the photosensitive belt 12 and the developing rollers 21Y–21K also can be prevented and a good toner image is obtained by the stabilization of developing characteristic. Further, amount of change in the tensile force applied to the photosensitive belt 12 that fluctuates when the developing rollers 21Y–21K are separated from the photosensitive belt 12 and when they are in contact with it is relieved, the change in running speed of the photosensitive belt 12 can be prevented, and color images of good quality are obtained without causing expansion and contraction of formed images and deviation of toner images in respective colors.

Further, according to this third embodiment, the back-up members 41Y–41K are moved to push out the photosensitive belt 12 to the developing rollers 21Y–21K and the photosensitive belt 12 is brought in contact with the developing rollers 21Y–21K. The driving energy required for bringing the photosensitive belt 12 and the developing rollers 21Y–21K or separating them can be reduced than when moving heavy developing devices 16Y–16K and furthermore, noises and vibrations when contacting or separating them are reduced and the contacting/separating operation can be made at high speed.

Further, the present invention is not restricted to the embodiments described above but can be deformed variously within the scope of the invention, for example, the moving members to move either the image carrier or the developing devices for contacting or separating are not restricted to eccentric cams but an electromagnetic clutch, etc. may be used. Further, sizes and amount of intrusion into an image carrier of developing members are optional in a range wherein good developed images are obtained.

Figure 16:
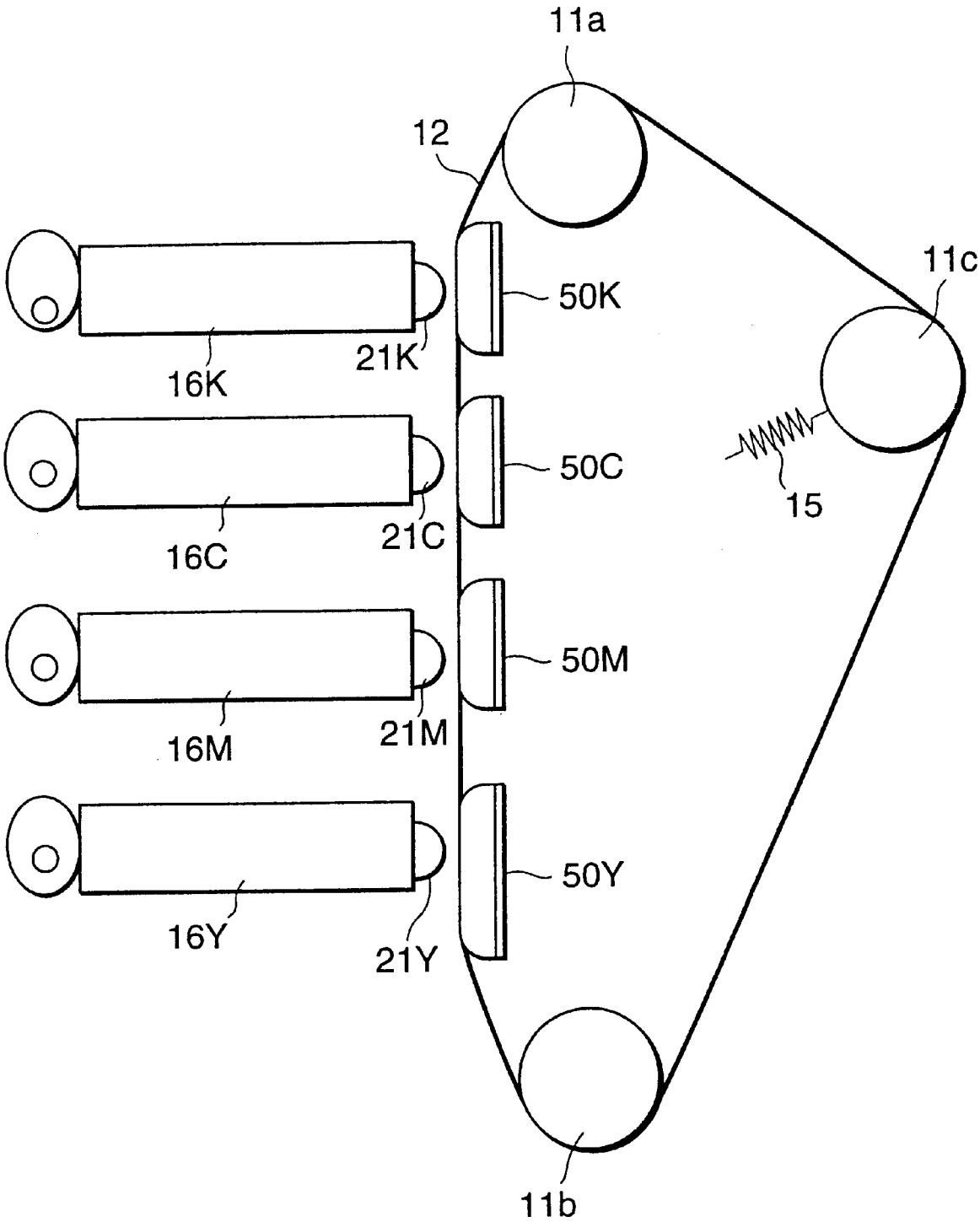
FIG. 16 is a schematic diagram showing the photosensitive belt and developing devices in a first modified example of the present invention.
Figure 17:
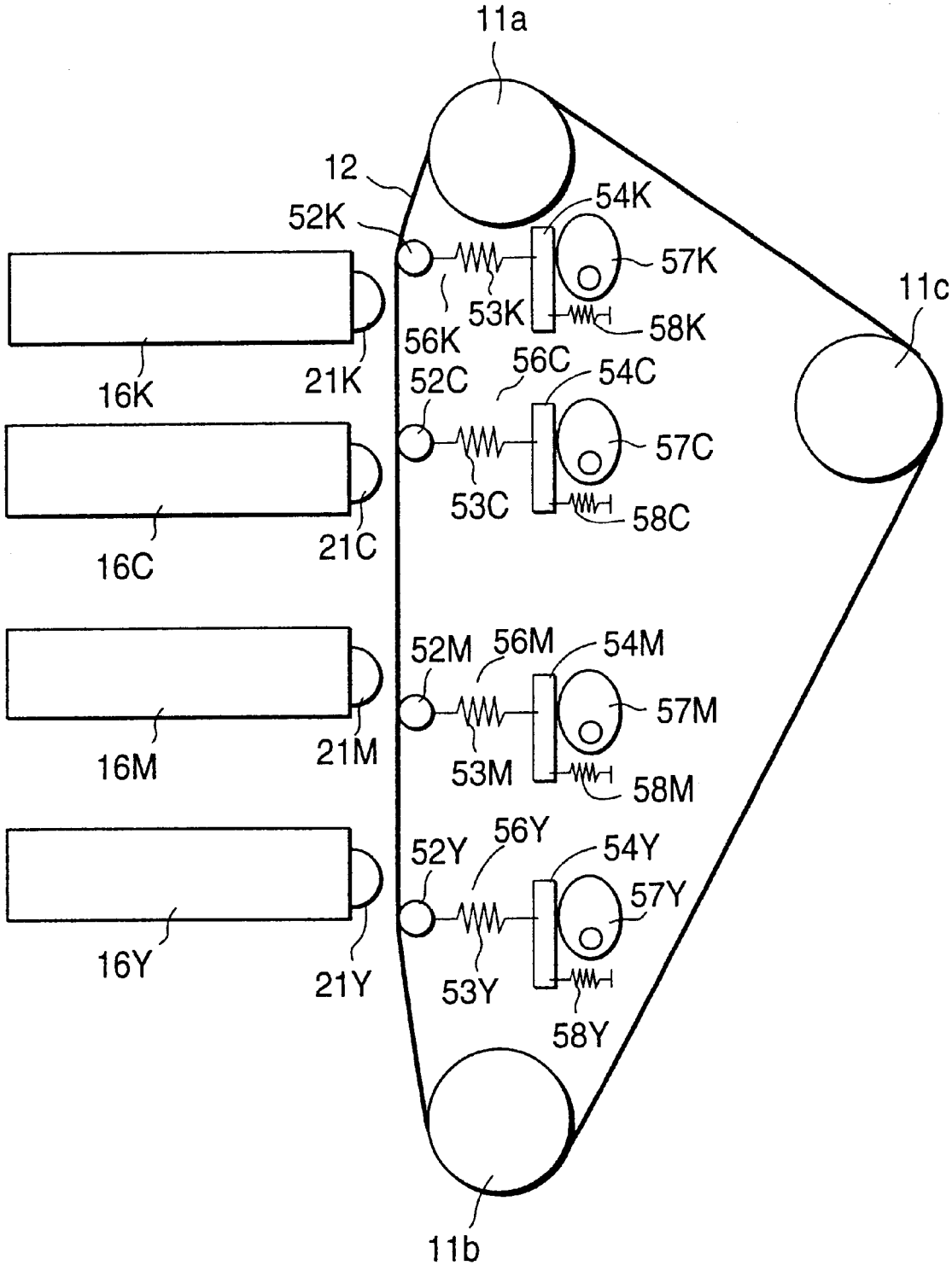
FIG. 17 is a schematic diagram showing the photosensitive belt and developers in a second modified example of the present invention.

Further, shapes and structures of the supporting members are not restricted and for example, the backup board in the second embodiment can be divided into the first through fourth back-up boards 50Y, 50M, 50C, 50K and arranged at positions opposing to the developing rollers 21Y–21K as shown in the first deformed example in FIG. 16. Also, for example, as the back-up members for moving the photosensitive belt 12 in the third embodiment, the first through the fourth back-up members 56Y, 56M, 56C, 56K provided for, oscillating the back-up rollers 52Y, 52M, 52C, 52K through the substrates 54Y, 54M, 54C, 54K may be used likewise the second deformed example shown in FIG. 17. In other words, by arranging the first through the fourth back-up members 56Y–56K in the intermediate areas of the nip portion between the photosensitive belt 12 and the four developing rollers 21Y–21K and moving the back-up members 56Y–56X by the eccentric cams 57Y, 57M, 57C, 57K and the springs 58Y, 58M, 58C, 58K to push out the photosensitive belt 12 to the developing rollers 21Y–21K side for contact/separation with the developing rollers 21Y–21K, and the tensile force of the photosensitive belt 12 may be adjusted by oscillating the back-up rollers 52Y–52K corresponding to the tensile force applied to the photosensitive belt 12 when the photosensitive belt 12 is brought in contact with the developing rollers 21Y–21K.

As described above in detail, according to the present invention, when the photosensitive belt is supported by the supporting members that fluctuate corresponding to the contacting force of the photosensitive belt with the developing rollers, the pressure at the nipping portion between the photosensitive belt and the developing rollers is adjusted and a large pressure to be applied to the nip portion is prevented, the relative speed of the photosensitive belt and the developing rollers is prevented to fluctuate, developing characteristic is stabilized and good toner images are obtained. Further, the tensile force that is applied to the photosensitive belt is prevented to fluctuate largely at the time of contacting/separating between the photosensitive belt and the developing rollers, the fluctuation of the running speed of the photosensitive belt is prevented and color images of good quality without expansion or contraction of image or deviation of image colors are obtained.

Accordingly, it is possible to dissolve improper image quality generated when securing a sufficient nip width by bringing the small developing rollers intrude into the photosensitive belt when developing images and achieve a small sized light weight image forming apparatus.

What is claimed is:

1. An image forming apparatus comprising:

an image carrier that runs endlessly;

a latent image forming portion for forming a latent image on the image carrier;

a developing device having a developing member that is capable of contacting or separating to/from the image carrier after passing the latent image forming portion and forming a developing image by supplying developer to the latent image;

a supporting member that contacts the surface opposite to the surface of the image carrier to contact the developing device and movably supporting the image carrier according to the contacting force between the developing member and the image carrier, wherein the latent image forming portion forms latent images in respective colors in order on the image carrier;

plural developers are provided for respective color developers and the developing member only of one of the developing devices is brought in contact with the image carrier and forms the developing image in any color in order, wherein one of the developing devices is moved to bring one of the developing members in contact with the image carrier or separate from it;

wherein the supporting member is an elastic member to press the image carrier to the developing member regardless of the contact/separation of the developing member with the image carrier; and wherein the elastic members are provided at the upstream side or the downstream side of the contacting area of the image carrier with the developing member.

2. An image forming apparatus according to claim 1, wherein the elastic member has a rotating member and a spring to press the rotating member to the image carrier side.

3. An image forming apparatus comprising:

an image carrier that runs endlessly;

a latent image forming portion for forming a latent image on the image carrier;

a developing device having a developing member that is capable of contacting or separating to/from the image carrier after passing the latent image forming portion and forming a developing image by supplying developer to the latent image;

a supporting member that contacts the surface opposite to the surface of the image carrier to contact the developing device and movably supporting the image carrier according to the contacting force between the developing member and the image carrier, wherein the latent image forming portion forms latent images in respective colors in order on the image carrier;

plural developers are provided for respective color developers and the developing member only of one of the developing devices is brought in contact with the image carrier and forms the developing image in any color in order, wherein one of the developing devices is moved to bring one of the developing members in contact with the image carrier or separate from it;

wherein the supporting member is an elastic member to press the image carrier to the developing member regardless of the contact/separation of the developing member with the image carrier;

wherein the elastic member is provided facing the contact area of the developing member with the image carrier;

wherein the elastic member is a board made of elastic material; and wherein the board has a surface layer for reducing friction with the image carrier.

4. An image forming apparatus according to claim 3, wherein the board is provided opposing to the whole contacting area of plural developing members with the image carrier.

5. An image forming apparatus comprising:

an image carrier that runs endlessly;

a latent image forming portion for forming a latent image on the image carrier;

a developing device having a developing member that is capable of contacting or separating to/from the image carrier after passing the latent image forming portion and forming a developing image by supplying developer to the latent image; and a supporting member that contacts the surface opposite to the surface of the image carrier to contact the developing device and movably supporting the image carrier according to the contacting force between the developing member and the image carrier, wherein the latent image forming portion forms latent images in respective colors in order on the image carrier;

plural developers are provided for respective color developers and the developing member only of one of the developing devices is brought in contact with the image carrier and forms the developing image in any color in order, wherein the supporting members are moved to bring the image carrier in contact with one of the developing members or separate them;

wherein the supporting members are elastic members to press the image carrier to the developing member side when the developing members contact the image carrier; and wherein the elastic members are provided at either the upstream side or the downstream side from the contacting portion of the image carrier with the developing members.

6. An image forming apparatus according to claim 5, wherein the elastic member has a rotating member contacting the image carrier and a spring to compress the rotating member to compress the rotating member to the image carrier side.

7. An image forming apparatus comprising:

a belt-shaped photo-conductor;

a latent image forming portion for forming a latent image on the image carrier;

a developing device having a developing roller that is capable of contacting to or separating from the photo-conductor after passing the latent image forming portion and forming a developing image by supplying developer to the latent image;

a developer moving member for moving the developing device, bringing the developing roller in contact with the photo-conductor or separating from it;

a supporting member for contacting the surface opposite to the surface where the photo-conductor contacts the developing roller and supporting the photo-conductor movably according to the contacting force of the developing roller with the photo-conductor, wherein the latent image forming portion forms latent images in respective colors in order on the photo-conductor;

the developing device is provided in plural units;

the developing device moving member moves one of the developing device according to the latent image and forms the developing image in optional color in order by bringing only one of the developing rollers in contact with the photo-conductor, wherein the supporting member is an elastic member to compress the photo-conductor to the developing roller side regardless of the contact/separation of the developing roller to/from the photo-conductor; and wherein the elastic member is provided at least either at the upstream side or the downstream side from the contacting area of the photo-conductor and have the back-up rollers contacting the photo-conductor and a spring to compress a back-up roller to the photo-conductor.

8. An image forming apparatus according to claim 7, wherein an intermediate transferring member on which the developing images in optional colors formed on the photo-conductor in order are sequentially laminated and transferred is provided at a position to contact the photo-conductor after passing the contacting area with the developing rollers.

9. An image forming apparatus comprising:

a belt-shaped photo-conductor;

a latent image forming portion for forming a latent image on the image carrier;

a developing device having a developing roller that is capable of contacting to or separating from the photo-conductor after passing the latent image forming portion and forming a developing image by supplying developer to the latent image;

a developer moving member for moving the developing device, bringing the developing roller in contact with the photo-conductor or separating from it;

a supporting member for contacting the surface opposite to the surface where the photo-conductor contacts the developing roller and supporting the photo-conductor movably according to the contacting force of the developing roller with the photo-conductor, wherein the latent image forming portion forms latent images in respective colors in order on the photo-conductor;

the developing device is provided in plural units;

the developing device moving member moves one of the developing device according to the latent image and forms the developing image in optional color in order by bringing only one of the developing rollers in contact with the photo-conductor;

wherein the supporting member is an elastic member to compress the photo-conductor to the developing roller side regardless of the contact/separation of the developing roller to/from the photo-conductor;

wherein the elastic member is a back-up board made of an elastic body provided opposing to the contacting area of the developing roller with the photo-conductor; and wherein the back-up board has a surface layer to reduce friction with the photo-conductor.

10. An image forming apparatus according to claim 9, wherein the back-up boards are provided opposing to the whole contacting area of the plural developing rollers with the photo-conductor.

11. An image forming apparatus according to claim 10, wherein at the position to contact the photo-conductor after passing the contacting area with the developing rollers, the intermediate transferring member is provided, on which the developing images in optional colors formed on the photo-conductor in order are laminated and transferred in order.

12. An image forming apparatus comprising:

a belt-shaped photo-conductor;

a latent image forming portion for forming latent images on the photo-conductor;

a developing device that is able to contact /separate to/from the photo-conductor after passing the latent image forming portions and has a developing roller for forming a developing image by supplying developer to the latent image;

a photo-conductor moving member for moving the photo-conductor to bring in contact with or separate from the developing rollers;

a supporting member for contacting the surface that is opposite to the surface of the photo-conductor to contact the developing rollers when contacting the developing roller and for supporting the photo-conductor movably according to the contacting force of the developing roller with the photo-conductor, wherein the photo-conductor moving member moves the supporting member, brings the developing roller in contact with or separate from the photo-conductor; and the supporting member comprises an elastic member to press the photo-conductor to the developing roller side when the developing rollers contact the photo-conductor, and wherein the elastic member is provided at either the upstream side or the downstream side from the contacting area of the developing roller with the photo-conductor and has a back-up roller contacting the photo-conductor and a spring to compress the backup roller to the photo-conductor.

13. An image forming apparatus according to claim 12, wherein an intermediate transferring member is provided at a position wherein the developing rollers contact the photo-conductor after passed the contacting area with the developing rollers and the developing images in optional colors that are formed on the photo-conductor in order are sequentially laminated and transferred.

* * * * *